US005961000A

United States Patent [19]

Sanfilippo et al.

[11] Patent Number: 5,961,000

[45] Date of Patent: Oct. 5, 1999

[54] SYSTEM AND METHOD FOR FILLING AND SEALING CONTAINERS IN CONTROLLED ENVIRONMENTS

[76] Inventors: James J. Sanfilippo, 505 N. Lake Shore Dr./Suite 6806, Chicago; John E. Sanfilippo, P.O. Box 952, Barrington, both of Ill.

[21] Appl. No.: 08/749,035

[22] Filed: Nov. 14, 1996

[51] Int. Cl.[6] ..... B65B 31/00; B65B 31/04

[52] U.S. Cl. ..... 222/152; 222/195; 222/1; 141/47; 141/67; 53/432; 53/510; 99/471

[58] Field of Search ..... 141/47–49, 59, 141/7, 67, 5, 68, 91; 222/152, 185.1, 195, 460, 1; 53/432, 510; 406/137, 138; 99/471, 474, 475, 516

[56] References Cited

U.S. PATENT DOCUMENTS

| | | | |
|---|---|---|---|
| 268,477 | 12/1882 | Fish . | |
| 789,699 | 5/1905 | Lorenz . | |
| 1,406,380 | 2/1922 | Heath et al. . | |
| 1,639,828 | 8/1927 | Wheeler et al. . | |
| 1,928,903 | 10/1933 | Manning | 99/516 |
| 1,940,013 | 12/1933 | Petersen . | |
| 2,131,876 | 10/1938 | Hurst . | |
| 2,140,187 | 12/1938 | Kantor . | |
| 2,199,565 | 5/1940 | Kantor . | |
| 2,227,190 | 12/1940 | Kronquest . | |
| 2,240,655 | 5/1941 | Kronquest . | |
| 2,292,897 | 8/1942 | Nielsen | 222/195 |
| 2,362,799 | 11/1944 | Boyd et al. . | |
| 2,439,773 | 4/1948 | Hohl et al. . | |
| 2,519,353 | 8/1950 | Cassady . | |
| 2,521,746 | 9/1950 | Preis . | |
| 2,534,305 | 12/1950 | Sharf . | |
| 2,630,958 | 3/1953 | Hohl . | |
| 2,649,671 | 8/1953 | Bartelt . | |
| 2,660,352 | 11/1953 | Renard . | |
| 2,768,487 | 10/1956 | Day et al. | 53/407 |
| 2,869,301 | 1/1959 | Stover . | |
| 2,978,336 | 4/1961 | Morrison . | |
| 3,056,244 | 10/1962 | Bartels . | |
| 3,087,823 | 4/1963 | Hein et al. . | |
| 3,103,771 | 9/1963 | Gräfingholt . | |
| 3,104,030 | 9/1963 | Howlett | 222/195 |
| 3,117,873 | 1/1964 | Bartels et al. . | |
| 3,188,144 | 6/1965 | Gmur et al. | 222/195 |
| 3,220,153 | 11/1965 | Cormack, Jr. et al. . | |
| 3,220,157 | 11/1965 | Buchner . | |
| 3,223,457 | 12/1965 | Albert | 406/138 |
| 3,261,379 | 7/1966 | Stockel et al. | 141/68 |
| 3,290,733 | 12/1966 | Miller | 141/67 |
| 3,340,668 | 9/1967 | Bofinger . | |
| 3,343,888 | 9/1967 | Anderson et al. | 406/138 |
| 3,347,534 | 10/1967 | Dawson . | |
| 3,415,310 | 12/1968 | Kulhmann . | |

(List continued on next page.)

FOREIGN PATENT DOCUMENTS

| | | |
|---|---|---|
| 447131 | 3/1948 | Canada . |
| 463300 | 2/1950 | Canada . |
| 1309992 | 9/1989 | Canada . |
| 0 184 166 | 6/1986 | European Pat. Off. . |
| 33 23 710 A1 | 10/1985 | Germany . |
| 0139313 | 5/1990 | Japan . |
| 466 786 | 1/1969 | Switzerland . |
| 551271 | 2/1943 | United Kingdom . |
| 2 086 834 | 5/1982 | United Kingdom . |
| 2 217 672 | 11/1989 | United Kingdom . |
| WO 95/31375 | 11/1995 | WIPO . |

*Primary Examiner*—J. Casimer Jacyna
*Attorney, Agent, or Firm*—Baniak Nicholas Pine & Gannon

[57] ABSTRACT

An open-architecture system for filling and sealing containers in controlled environments. The system provides easy access to containers being processed, and minimizes start-up times and waste. Containers are processed by gas distributors (which may comprise gassing rails) provided in segments and individually movable between operating and service positions. Exhaust plenums are described for improving function of the gas distributors when processing containers. Gas exchange systems including on-demand processors and improved gassing elements are provided. An independent processor is provided to receive, correct and environmentally process defective (e.g. underfilled or overfilled) containers.

16 Claims, 5 Drawing Sheets

U.S. PATENT DOCUMENTS

| | | | |
|---|---|---|---|
| 3,466,841 | 9/1969 | Rausing . | |
| 3,486,295 | 12/1969 | Rausing et al. . | |
| 3,488,915 | 1/1970 | Delestatius . | |
| 3,508,373 | 4/1970 | Robinson, Jr. . | |
| 3,511,022 | 5/1970 | Finley et al. . | |
| 3,545,160 | 12/1970 | Jantze et al. . | |
| 3,584,661 | 6/1971 | Riesenberg . | |
| 3,619,975 | 11/1971 | Johnson et al. | 53/512 |
| 3,645,583 | 2/1972 | Heath | 406/138 |
| 3,653,639 | 4/1972 | Mueller | 406/138 |
| 3,676,673 | 7/1972 | Coleman . | |
| 3,708,952 | 1/1973 | Schulze et al. | 53/512 |
| 3,747,296 | 7/1973 | Zausner . | |
| 3,768,867 | 10/1973 | Krambrock | 406/137 |
| 3,789,888 | 2/1974 | James et al. . | |
| 3,807,052 | 4/1974 | Troue . | |
| 3,814,295 | 6/1974 | Steltz | 222/195 |
| 3,837,137 | 9/1974 | Yatsushiro et al. . | |
| 3,860,047 | 1/1975 | Finkelmeier et al. | 141/47 |
| 3,861,116 | 1/1975 | Domke . | |
| 3,862,707 | 1/1975 | Reiter | 406/138 |
| 3,871,157 | 3/1975 | Domke et al. . | |
| 3,881,300 | 5/1975 | Zetterberg . | |
| 3,910,009 | 10/1975 | Canfield . | |
| 3,933,280 | 1/1976 | Plumb | 406/138 |
| 3,936,950 | 2/1976 | Troue . | |
| 3,939,287 | 2/1976 | Orwig et al. . | |
| 3,942,301 | 3/1976 | Domke . | |
| 4,014,153 | 3/1977 | Wilson | 53/431 |
| 4,014,158 | 3/1977 | Rausing . | |
| 4,016,705 | 4/1977 | Wilson et al. . | |
| 4,027,450 | 6/1977 | Chiu et al. . | |
| 4,036,408 | 7/1977 | Dugge | 406/137 |
| 4,094,121 | 6/1978 | Ganholt | 53/432 |
| 4,140,159 | 2/1979 | Domke . | |
| 4,148,933 | 4/1979 | Janovtchik . | |
| 4,154,044 | 5/1979 | Lang . | |
| 4,458,734 | 7/1984 | Scholle et al. . | |
| 4,498,508 | 2/1985 | Scholle et al. . | |
| 4,588,000 | 5/1986 | Malin et al. . | |
| 4,602,473 | 7/1986 | Hayashi et al. . | |
| 4,658,566 | 4/1987 | Sanfilippo . | |
| 4,696,226 | 9/1987 | Witmer | 98/36 |
| 4,703,609 | 11/1987 | Yoshida et al. . | |
| 4,733,818 | 3/1988 | Aghnides . | |
| 4,768,326 | 9/1988 | Kovacs . | |
| 4,791,775 | 12/1988 | Raque et al. . | |
| 4,817,518 | 4/1989 | Wyatt et al. | 99/516 |
| 4,823,680 | 4/1989 | Nowotarski | 98/36 |
| 4,827,696 | 5/1989 | Arends et al. . | |
| 4,831,811 | 5/1989 | Nixon, Jr. et al. . | |
| 4,905,454 | 3/1990 | Sanfilippo et al. | 53/432 |
| 4,941,306 | 7/1990 | Pfaffmann et al. . | |
| 4,962,777 | 10/1990 | Bell . | |
| 4,964,259 | 10/1990 | Yivisaker et al. . | |
| 4,982,555 | 1/1991 | Ingemann . | |
| 4,996,071 | 2/1991 | Bell . | |
| 5,001,878 | 3/1991 | Sanfilippo et al. | 53/510 |
| 5,017,053 | 5/1991 | Sisk | 406/138 |
| 5,020,303 | 6/1991 | Vokins . | |
| 5,054,265 | 10/1991 | Perigo et al. . | |
| 5,069,020 | 12/1991 | Sanfilippo et al. | 53/510 |
| 5,071,667 | 12/1991 | Grüne et al. . | |
| 5,121,590 | 6/1992 | Scanlan . | |
| 5,159,799 | 11/1992 | Rising et al. . | |
| 5,178,841 | 1/1993 | Vokins et al. . | |
| 5,201,165 | 4/1993 | Marano et al. . | |
| 5,228,269 | 7/1993 | Sanfilippo et al. | 53/432 |
| 5,230,203 | 7/1993 | Wu et al. | 53/471 |
| 5,247,746 | 9/1993 | Johnson et al. . | |
| 5,323,589 | 6/1994 | Linner . | |
| 5,371,998 | 12/1994 | Johnson et al. . | |
| 5,417,255 | 5/1995 | Sanfilippo et al. | 141/1 |
| 5,452,563 | 9/1995 | Marano et al. . | |
| 5,473,860 | 12/1995 | Linnér . | |

9
2
4
1
10
3
10
12
12
10
6
12
11
5
7
8
58
11
13
11
50
59
52

13
17
3

16
3
15
25

15
23
22
16
17
24
11
21
19
50

38
16
15
17
11
38
37a
37b
39a
39b
13
52

26
17
15
39a
16

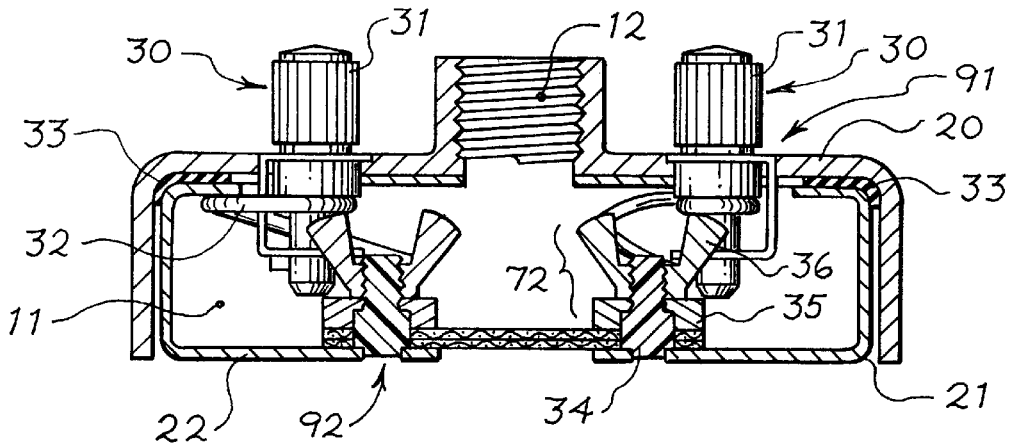
Fig. 6
Fig. 7
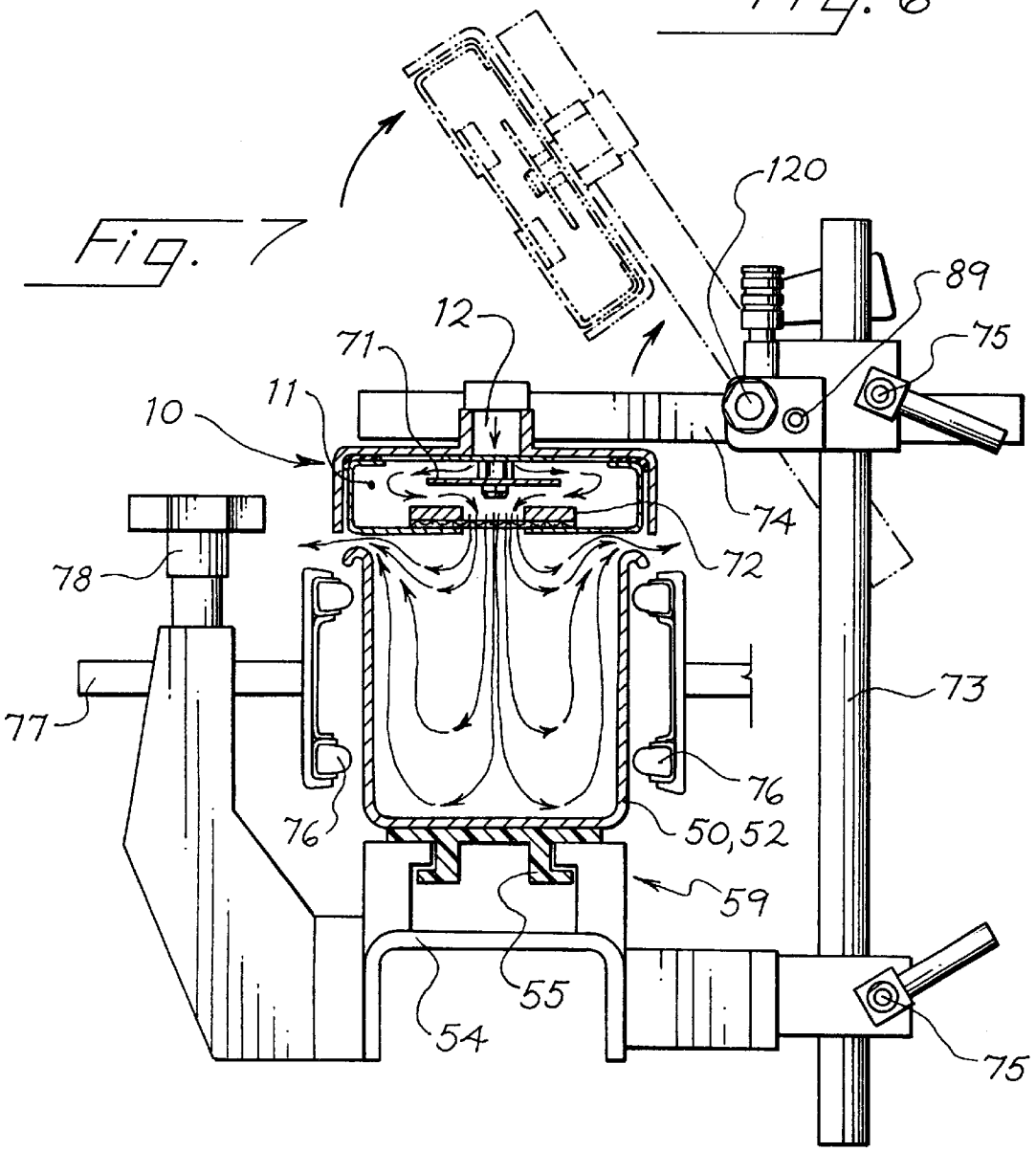

Fig. 14
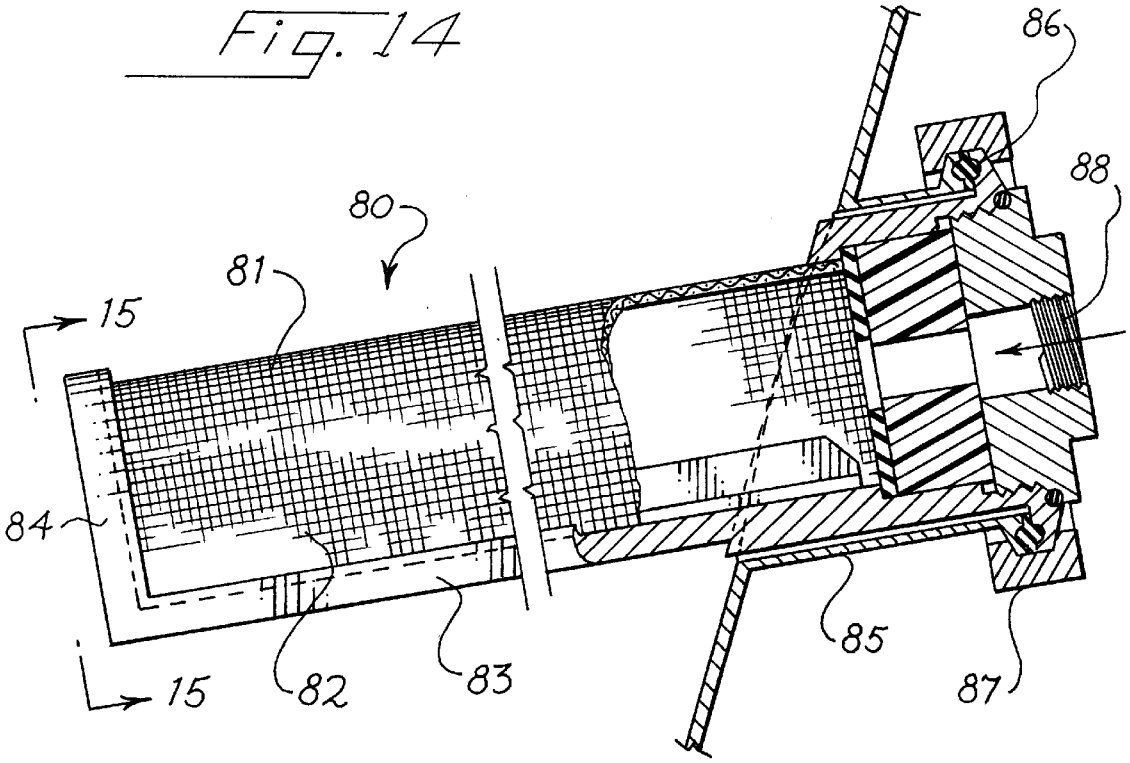
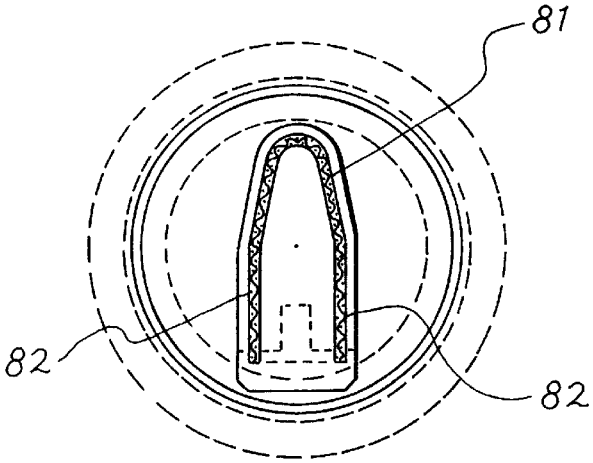
Fig. 15

SYSTEM AND METHOD FOR FILLING AND SEALING CONTAINERS IN CONTROLLED ENVIRONMENTS

RELATED APPLICATIONS

This application claims priority to PCT Application No. 95/06248 filed May 17, 1995.

TECHNICAL FIELD

The invention relates to apparatus and method for packaging materials in selected alternate environments, and in particular for substantially oxygen-free packaging of food products in containers.

BACKGROUND ART

In the food packaging industry various techniques exist for sequentially packaging containers of food product in alternate environments such as an inert atmosphere to substantially reduce the oxygen level and thereby preserve freshness. Such processes are beneficial for packaging of various food products, including edible nuts, coffee, powdered milk, infant formula, among others. Existing systems have limitations which reduce the efficiency and speed of the packaging operation. In addition, certain packaging system designs remove the choice of using a variety of modern filling and seaming equipment.

For example, techniques are known for flushing the interior of empty containers before filling with contents, to reduce residual oxygen. Techniques are also known for reducing oxygen content in the food material prior to packaging, and for transporting filled containers. However, known apparatus for performing these functions have shortcomings which have prevented their widespread adoption. These include excessive gas consumption, inflexible design which restricts operator access, lower operating speeds, requirements for vacuum sources or bulky apparatus, and long start-up and re-start delays.

By way of example, U.S. Pat. Nos. 3,871,157, 3,942,301 and 4,140,159 and German 0S 3323710 disclose various apparatus for low-oxygen packaging including particular forms of gas distributors and bulk product purging. U.S. Pat. No. 3,860,047 discloses an apparatus for flushing oxygen from bulk material to be packaged, including gas delivery tubes. U.S. Pat. No. 4,094,121 discloses another apparatus for packaging products in substantially oxygen-free atmosphere, including a simple inlet for inserting inert gas to be forced upwards through a filling tube and filling funnel. These known systems all suffer from inflexible structure, undesirably high gas consumption, potential adverse stratification of bulk product as a result of flushing gas flows, and limited speed.

It is therefore desired to provide a system and method for packaging product in selected (e.g. inert) environments using generally open and accessible structures. Further, it is desirable to provide such a system which will permit very low residual oxygen levels in packaged product, while consuming less inert gas and avoid stratification of bulk material. Finally, it is highly desirable to provide such an integrated gassing system which is adaptable to containers having multiple sizes, and is usable at high throughputs.

DISCLOSURE OF INVENTION

An open architecture, integrated container filling and sealing system is provided which comprises a pre-purging system (e.g. rail), a filling station including apparatus for removing oxygen from a bulk material prior to packaging, a headspace purging rail, and a permanent sealing station. In a particular embodiment, the system consists essentially of only these major processing elements, without need for other inert gas or vacuum processors, yet is capable of commercial packaging of e.g. infant formula at high rates (e.g. 200 pounds per minute and higher) with residual oxygen levels of 1% or less.

In a preferred embodiment, empty containers are transported beneath a specially designed purging rail, then filled with product which has been processed itself to remove substantially all oxygen, and finally the filled container is transported beneath a headspace purging rail to an apparatus for sealing the container. Preferably both the container purging rail and the headspace purging rail comprise one or more plenums mounted above open containers on a conveying apparatus, in close proximity to the container openings. The plenum is supplied with a desired alternate environment, such as inert gas. A longitudinally extended manifold for controlled passage of gas from the interior of the plenum toward the container openings is provided in the surface of the plenum proximate the containers, which is narrower than the container opening and preferably less than or equal to one half of the width of the container opening, and in a particularly preferred embodiment, one quarter of the width of the container opening or less.

The rails preferably comprise a plurality of segments, mounted to permit individual segments to be easily moved away from the associated conveyor and containers to allow access to a portion of the system and containers being processed. In particular embodiments, segments may be hinged or slide mounted to allow rotational and/or translational movement from a first operating position to a second service position.

Exhaust plenums may be provided in conjunction with a gas distributor (such as a gassing rail) to receive the expelled gas and oxygen. In preferred embodiments, the exhaust plenums include an extended manifold for controlled (preferably laminar) gas induction.

A filling station includes apparatus for removing substantially all oxygen from a product to be packaged, prior to filling the container. Preferably the filling station includes a hopper, an on-demand gas exchanger, and a filler. The hopper (when used) may include at least one gassing region for providing a controlled and preferably laminarized flow of inert gas into the hopper. The on-demand gas exchanger (when used) provides a more compact vessel (providing greater installation flexibility), including an enclosed volume through which the product flows just prior to packaging, and includes gassing elements for providing a controlled flow of inert gas through the product to displace oxygen in real time as product flows to the filler for filling. In some embodiments the hopper and gas exchanger may be integral. The filler may be of any conventional type, though modified (if necessary) to prevent oxygen entrainment as the processed product passes into the processed containers and as the containers enter and exit the filler.

In preferred embodiments, the hopper (or gas exchanger) is provided with a plurality of individual gassing elements arranged so as to generate overlapping gassing regions. In a preferred embodiment the elements are substantially coplanar and spaced about the interior volume of a vessel. In particularly preferred embodiments, more than one level of gassing elements is provided, to create multiple zones of oxygen exclusion as product moves through the associated hopper or gas exchanger. For example, two levels, each having three or four gassing elements and offset relative to each other, are preferred. The gassing elements preferably include an extended manifold surface for injecting gas in a controlled (preferably laminar) manner over a significant surface area, thereby preventing excessive velocity or turbulence. In preferred embodiments, a rigid support frame supports an extended wire mesh manifold surface, defining an interior plenum which receives an inert gas supply. Preferably the wire mesh manifold has a top portion (in the direction of approaching product) which is tapered. A lower portion with generally parallel sides may also be included, to provide additional surface area without adversely affecting flow of particulate material through the vessel.

In certain embodiments, merging rails (such as headspace purging rails) may be provided proximate the main rail(s) for introduction of containers to the container stream. In a system, a secondary oxygen flushing station may be included for processing containers, which may then be transported beneath a merging rail for introduction into a stream of containers, without risk of oxygen contamination.

Other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

BRIEF DESCRIPTION OF THE DRAWINGS

FIG. 6 is a side sectional view of a preferred rail and manifold structure.

FIG. 7 is a partially sectional view of preferred conveyor and rail support members including hinges.

FIG. 14 is a partially sectional side view of a representative gassing element for use with a gassing hopper or gas exchanger.

FIG. 15 is an end view of the gassing element, taken from line 15—15 in FIG. 14.

BEST MODE FOR CARRYING OUT THE INVENTION

Figure 1:
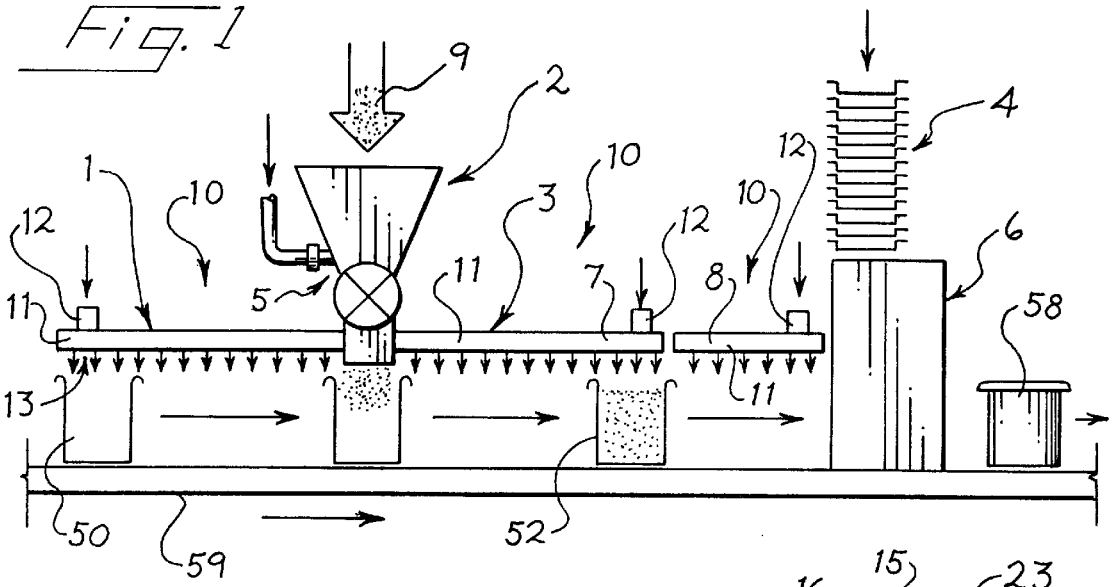
FIG. 1 is a schematic view of an integrated container filling and sealing system.

Referring to FIG. 1, a schematic view of an integrated controlled environment filling and sealing system is shown having gas purging tails 10 including a pre-purging rail 1 and a headspace purging rail 3, a filler station 2 between the rails 1 and 3, and a sealing station 6 (such as a double seamer). The filling station 2 preferably includes a controlled environment processor 5.

The gas purging rails 10 include a longitudinal plenum 11 having one or more inlets 12 for receiving e.g. inert gas from a source (not shown), and a distribution manifold 13 for distributing the gas into the open containers. The distribution manifold 13 is located on a surface of the rail 10 facing the containers. Where extended rails are desired (e.g. to increase residence time of the containers beneath the rail to allow adequate time at a given line speed for sufficient oxygen displacement), the gas purging rail 10 may comprise a plurality of individual segments (e.g. 7, 8) each having its own plenum 11 and gas inlet(s) 12. Preferably, the manifolds 13 of adjacent segments are closely proximate one another (i.e. most preferably within ⅛ inch) to minimize any disruption of the longitudinally smooth gas flow from the manifolds. For a preferred line speed of about 400 size 401 containers per minute, a total pre-purging rail length of approximately 12 feet and residence time beneath the rail of 4–6 seconds is desirable.

The vertical distance between the manifold 13 and the tops of the open top containers is preferably small, and ideally should not exceed about 0.375 inches for the embodiments illustrated. Preferably, for a pre-purge rail 1 this separation is between about 0.0625 and about 0.25 inches, not exceeding about 0.31 inches, and optimally about 0.125 inch. For a headspace rail the separation is preferably between about 0.016 and about 0.19 inches, not exceeding about 0.375 inches and optimally as small as possible without physical interference between the rail and containers. For size 401 cans, a segment of plenum 11 may have a height of about 1.0 inch, a length of about 4 feet, and a width of about 5.0 inches. A standard 401 container has a height of 5.438 inches and an outer diameter of 4.1 inches. The inert gas has an inlet and an outlet flow rate of about 2 to about 15 standard cubic feet per minute (2–15 scfm), preferably about 10 scfm per 4 foot segment at 100% flow when packaging size 401×502 containers at a line speed of 300 containers per minute. For a headspace rail segment, the optimum rate is about 5 scfm per segment at 100% flow rate. The optimum inert gas flow rate will vary depending on line speed and container dimensions, and can be determined through wind tunnel testing of the various sized containers.

Preferably, the plenum 11 is closed except for the inert gas inlet(s) 12 and the distribution manifold 13. The plenum 11 may be rectangular as shown, and may be constructed of stainless steel, aluminum, rigid plastic or any other rigid material. The plenum 11 should preferably be at least as wide as, and more preferably somewhat wider than, the diameters of the open top of the containers. In a preferred embodiment, a 2.5 inch strip of 40 micron 5-ply stainless steel screen 23 is mounted on a 2.5 inch strip of 80 micron 2-ply stainless steel screen 24 and forms in part the exposed gas manifold. By providing opening regions in one or both of the mesh layers (preferably not overlapping), differing regions of flow resistance are provided.

In operation of a preferred embodiment, an open empty container 50 may be exposed to a controlled (preferably laminarized) flow of inert gas from the pre-purging rail 1 as it is transported by conveyor 59, which may reduce the oxygen levels within the container from 20.9% to less than 2.0% residual oxygen. It has been found that oxygen residuals as low as a few hundred parts per million oxygen or less are possible with residence times of 4–6 seconds. Because the rails 1 as described herein do not require vacuum, side panels or a sealed enclosure to process the empty containers 50, an open architecture is provided which permits easy access to the containers when necessary. Preferably the pre-purging rails 1 include at least one longitudinally oriented gas distribution manifold region substantially aligned with the direction of movement of containers being transported in association with the pre-purging rail. The manifold provides a controlled flow of e.g. inert gas into the open containers, which flow is substantially continuous and uniform in the direction of container movement. Preferably the manifold provides at least two extended longitudinal regions of differing gas flow resistance. Preferably the manifold has a width which is less than the width of the container opening, and most preferably one half or one quarter or less of the container opening width. It should be understood that "longitudinal" direction is used herein to refer to the direction of container movement, which may be linear or non-linear (e.g. curved), planar or non-planar, depending on the conveyor or transport system associated with the gas rail.

The filler station 2 includes apparatus for portioning the bulk product 9 to be packaged and delivering it to the empty containers 50. In addition, apparatus 5 is provided for removing oxygen from the bulk product 9 prior to filling the container 50. This alternate environment processor 5 preferably has a plurality of gassing elements in the flow stream of the bulk product 9, to provide a laminarized flow of inert gas through the bulk product to substantially reduce oxygen levels in the product and prevent reintroduction of oxygen during filling of the pre-purged container.

The filled containers 52 then exit the filler station 2, beneath a headspace purging rail 3. The headspace purging rail 3 flushes the headspace of the filled container 52 with a controlled flow pattern of inert gas to remove any oxygen contamination that may occur as containers exit the filler station, and to maintain the inert environment as the container is transported. Like the pre-purging rail 1, the headspace rail 3 may preferably have an open architecture to permit access to filled containers 52, and manifolds of the type described above.

It has been discovered that highly efficient, high speed, very low oxygen residuals may be achieved by a system consisting essentially only of the processing elements discussed. In other embodiments, the container 52 may enter further environmental processing station(s) (not shown), such as a vacuum chamber or additional gassing station. A lid placement system 4 may be provided. The container 52 may be transported to a permanent sealing station 6 where a closure is secured. The sealed container 58 may then be removed.

This unique combination of container processing elements, including pre-purging and headspace purging by means of open architecture gassing rails and manifolds as described herein, provides for low oxygen residual in the filled container and very efficient (minimized) use of inert gas. The resulting open architecture allows easy access to containers 50, 52, and avoids complex tunnels, gas seals, vacuum processors, and other interfering structures. Segmented rails and hinged mounting of segments as discussed below further enhance the openness of the resulting system, and add to its superior operation.

Figure 2:
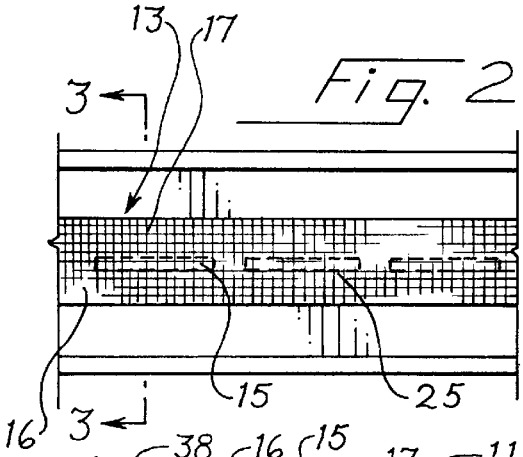
FIG. 2 is a bottom view of a gassing rail showing the outer face of a preferred gas distribution manifold.
Figure 3:
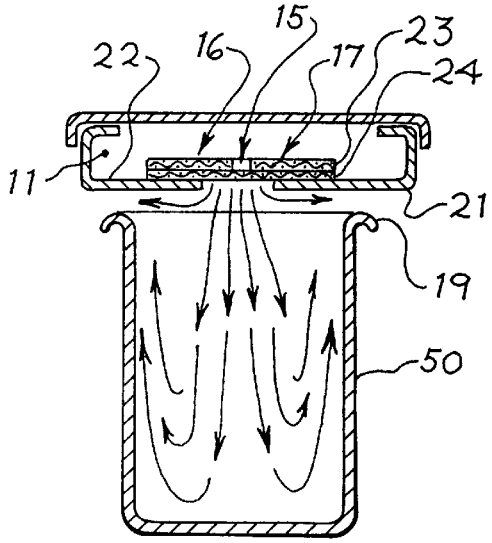
FIG. 3 is a sectional view of a single container being purged by a pre-purging rail, taken along line 3—3 in FIG. 2.
Figure 4:
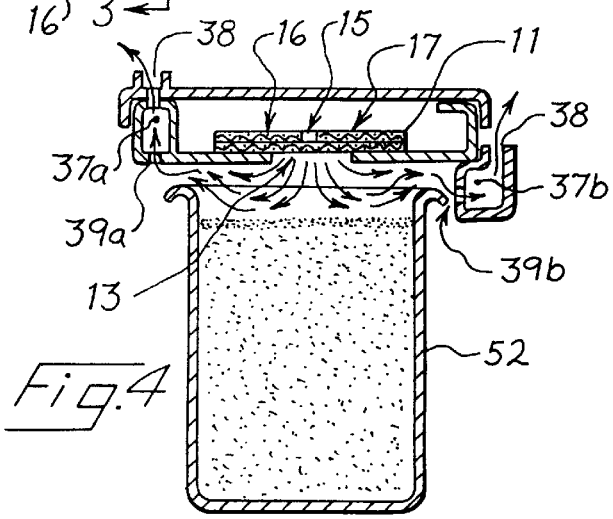
FIG. 4 is a sectional view of a single container being purged by a headspace purging rail, taken along line 3—3 in FIG. 2.

Referring to FIGS. 2–4, a preferred distribution manifold 13 for the pre-purging rail and headspace purging rail includes a longitudinally oriented center area 15 of lower flow resistance, between and adjacent to two longitudinally oriented areas 16 and 17 of higher flow resistance. Each of the flow regions 15, 16 and 17 extends the length of the bottom surface of plenum 11, is positioned above the open tops of the containers 50, 52, and is oriented in the direction of travel of the containers. In a preferred embodiment, the overall width of the distribution manifold 13 is smaller than the diameter of the openings of the containers, and most preferably less than one quarter of the width of the container opening.

For example, the manifold 13 may have an overall width of about 0.75–1.0 inch for containers having opening diameters of about 4–6 inches. The central region 15 of lower flow resistance may have a width of about 0.25 inch, and the surrounding regions 16 and 17 of higher flow resistance may each have a width of about 0.25–0.5 inch. Smaller containers may utilize smaller optimum manifold widths. For containers having opening diameters of about 2–3 inches, the manifold may have an overall width of 0.5 inches, with correspondingly smaller widths for the regions of higher and lower flow resistance.

The distribution manifold 13 is preferably positioned longitudinally in the center bottom surface of the plenum 11 and over the centers of moving containers 50, 52. In the pre-purging rails 1 inert gas passing through the center area 15 of lower flow resistance has a relatively high velocity, sufficient to carry the gas to the bottom of each container 50. In the headspace purging rails 3, the velocity of the inert gas passing through center area 15 is sufficient to carry to the top surface of the packaged product in the filled containers 52 and overcome any air infiltration during container transport. The arrows in FIGS. 3 and 4 show the preferred direction of travel of a preferably laminarized flow of inert gas. Inert gas passing through adjacent regions 16 and 17 of higher flow resistance may be partially carried into the containers 50, 52 by a "venturi" effect from the higher velocity gas. Otherwise, the gas passing through areas 16 and 17 has a lower velocity. Because the regions 15, 16 and 17 are oriented parallel to the direction of travel of the containers, the gas flow patterns (including the outflow) exist continuously and substantially at steady state for the entire time that each container remains underneath the surface of plenum 11. Therefore, there is no opportunity for oxygen to enter the containers from the outside. The oxygen content inside the containers steadily decreases as each container moves below the manifold 13 until the oxygen content is reduced to target levels or below, whereby the purging is completed.

The regions 15, 16 and 17 of high and low flow resistance can be created using adjacent welded screens of different opening size, selectively layered screens, porous plastic (e.g. porous high molecular weight high density polyethylene), porous plates, or any selectively porous material that acts as a diffuser.

Figure 5:
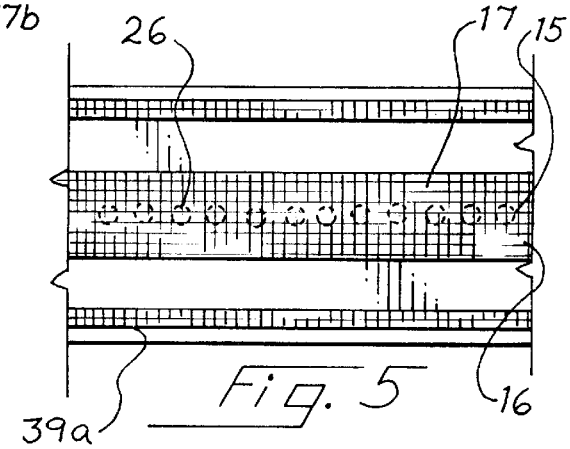
FIG. 5 is a bottom view of another gassing rail showing two embodiments of exhaust plenums.

In preferred embodiments of both the pre-purging rail 1 and the headspace purging rail 3, the manifold 13 may include a series of 0.25-inch wide and 3-inch long slots 25 formed in the center of a 5-ply 40 micron screen parallel to the direction of container travel (FIG. 2). The slots can be spaced about 0.75 inch apart from each other and provide the region of lower resistance to allow a higher velocity flow. The 0.75 inch spacing of the slots gives the rail more structural integrity, but a long continuous slot may be preferable. The screened regions on either side of the slots provide the high resistance regions 16, 17 which allow a lower velocity flow parallel to the low resistance region 15 and to the direction of container travel 7. In an alternative embodiment where a reduced requirement for inert gas exists, smaller holes 26 may be substituted for slots (FIG. 5).

FIG. 4 also illustrates two embodiments of exhaust plenums 37*a,b*. Such exhaust plenums may be provided in conjunction with a gas distributor, such as (but not limited to) a gassing rail 10, to receive all or a portion of the exiting gas and displaced oxygen-containing atmosphere. This may be advantageous, for example, where it is desired to minimize accumulation of exhausted inert gas, or where more precise control of the gas flow pattern in the regions adjacent the container openings is desirable. A source of exhaust (e.g. high or low vacuum) may be attached to outlets 38. The plenum 37 is then provided with one or more ports 39 through which the exhausted gases are drawn. Ports 39 may in some embodiment comprise an extended manifold, and may preferably be substantially coextensive longitudinally with the distribution manifold 13. In preferred embodiments, the ports may comprise a longitudinally extended opening, and may be covered by a fine wire mesh (see FIG. 5). In this manner, the gas flow patterns proximate to the port(s) is smoothed and preferably laminarized, to further reduce disruptive currents in the area of the container openings.

In the embodiment shown to the left of plenum 11 in FIG. 4, an exhaust plenum 37*a* is substantially contiguous with the gas plenum 11, and may share common elements with plenum 11. The gas ports 39*a,* which may comprise individual apertures, slots, mesh-covered manifold, or other configurations, are substantially co-planar with the distribution manifold 13 or lower surface of the rail. In the alternative embodiment illustrated to the right of plenum 11, exhaust ports 39*b* are provided at a level below rail, at or below the open surface of the container. These and other physical embodiments are possible, without departing from the scope of the present invention. Further, although exhaust plenums have been described in combination with certain preferred forms of gas distributors (such as gassing rails), they may be beneficial as well in combination with other known types of gas distributors or flushing systems.

FIG. 6 illustrates a particularly preferred configuration for the gas rail 10 and manifold 13. In particular, the rail comprises two major elements, an upper assembly 91 and a lower assembly 92. Assembly 91 may comprise a top plate 20 having a generally U-shaped cross section. All relatively permanent connections to the gas rail are preferably made to upper assembly 91, which therefore preferably comprises gas inlet 12 and means for mechanically supporting the assembled gas rail.

Lower assembly 92 is designed to be easily removable for cleaning, service or replacement of the manifold. In the embodiment illustrated, side members 21, 22 form a box which, when joined with upper assembly 91, defines a closed plenum 11. Quick-mount latches 30 are provided to selectively secure lower assembly 92 to upper assembly 91. In the embodiment illustrated, knobs or slotted members 30 are provided, attached to helical clamps 32 such that, when rotated, clamps 32 engage and secure a portion of side members 21, 22 against a cooperating portion of top member 20. Gaskets 33 may be provided to assure a gas tight seal. It will be understood that alternative means for connecting assemblies 91, 92 may instead be employed without departing from the scope of the present invention, as can alternate designs for the various elements comprising the plenum.

Lower assembly 92 may therefore be quickly separated from the more permanently attached upper assembly 91. In this manner, the lower elements can be quickly exchanged for others, such as when it is necessary to provide a clean manifold. This may be particularly important where different products are packaged at different times, and contamination must be carefully avoided.

Also illustrated in FIG. 6 are preferred means for mounting the manifold screens or elements to the lower assembly 92 to permit improved access for service and cleaning. In particular, threaded studs 34 are attached to the sides 21, 22. Cooperating apertures are provided in the manifold elements, which are then passed over the studs 34. Flattening bars or clamps 35 may be provided to assure a longitudinal seal to the manifold elements, which may be secured by e.g. wing nuts 36. A quick-mount structure 72 thereby results. It will be understood that other mounting structures 72 may alternatively be employed, such as spring or friction mounts. Alternatively, the manifold elements may be permanently attached to the supporting plenum structures.

As shown in FIG. 7, a baffle 71 may be located beneath gas inlet 12 to disperse the incoming gas within the plenum 11 and minimize noise. Although preferably solid, other embodiments may utilize permeable baffles, such as stainless steel mesh or perforated plate.

FIG. 7 also illustrates a preferred open architecture for the gassing rail systems. A conveyor 59 is provided to transport the containers (50, 52). Conveyor 59 may be any suitable type, including linear, curvilinear, circular, screw-feed, roller or other systems. In a preferred embodiment, support channel 54 supports interconnected conveyor elements 55, which are driven by motive means (not illustrated).

Proper orientation of the containers relative to the conveyor 59 may be assisted by means of optional guides 76. Preferably guides 76 are adjustable as shown (e.g. supported by adjustment rods 77 and secured by quick-adjustment knobs 78). This permits containers of different sizes to be quickly accommodated, and promotes the desired open architecture by allowing access to the conveyor stream when required.

Importantly, the gas purging rail segments 10 are preferably mounted in a manner that permits easy adjustment to accommodate different sized containers, and easy access to containers with minimum disruption of a packaging operation. For example, support members 73, 74 may be secured by quick adjustment clamps 75. In this manner, the rail 10 can be easily adjusted laterally to a centered location relative to the containers, and can be adjusted in height relative to conveyor elements 55 to assure a proper location and separation above the open container tops.

In a particularly preferred embodiment, the upper (horizontal) support member 74 is movable relative to lower (vertical) support member 73, which in turn is linked to the conveyor 59 (e.g. the support structures). The two members are joined by a selectively displaceable joiner such as a pivot or hinge 89, or translational slide. Accordingly, the gas rail 10 and related support structures can be quickly moved from a first operating position proximate the containers, to a second service position away from the stream of containers. As illustrated, hinges 89 may have a generally horizontal axis of rotation, offset from the rail so that the rail structure can be moved, without interference, away from containers. Alternatively, the rail segments 10 may be hinged to swing about a vertical or angled axis, or may be mounted on slides for translational movement. Compound hinges or articulated structures may also be used. In particularly preferred embodiments, the hinges 89 or other support structures permitting movement of the rail 10 provide for movement generally away from the remaining elements of a packaging apparatus, so that the rail segments may be moved from an operating position to a service position without disrupting other elements of the packaging apparatus.

Use of the present structure provides a highly accessible and open architecture which minimizes down time when a container must be inserted or removed from the system. By merely pivoting (and/or sliding) the relevant segment of the affected rail away from the conveyor, an operator can immediately obtain access to particular containers in process. However, the majority of containers may remain unaffected, since in preferred embodiments only a portion of the rail need be disrupted. Further, when the gassing rail segment is returned to its operating position, the system will quickly return to normal operating conditions since the volume of space contaminated by ambient oxygen is kept relatively small, compared to the large volume of e.g. known gas-filled conveyor tunnels. Although these beneficial mounting structures have been described in connection with preferred forms of gas distributors (e.g. gassing rails), they may be beneficial in combination with other known forms of gas distributors as well.

Figure 8:
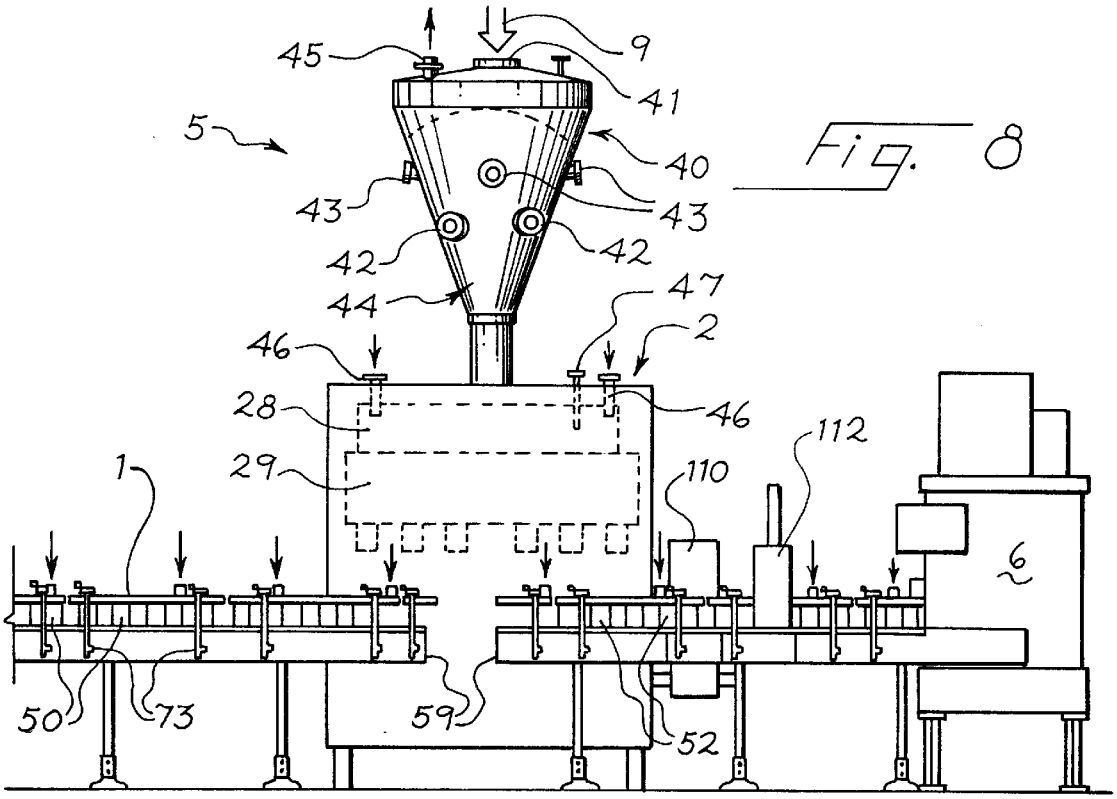
FIG. 8 is a side view of a representative commercial embodiment of the present invention, including a supply hopper having a plurality of gassing elements, and an optional secondary processor and merging rails.
Figure 9:
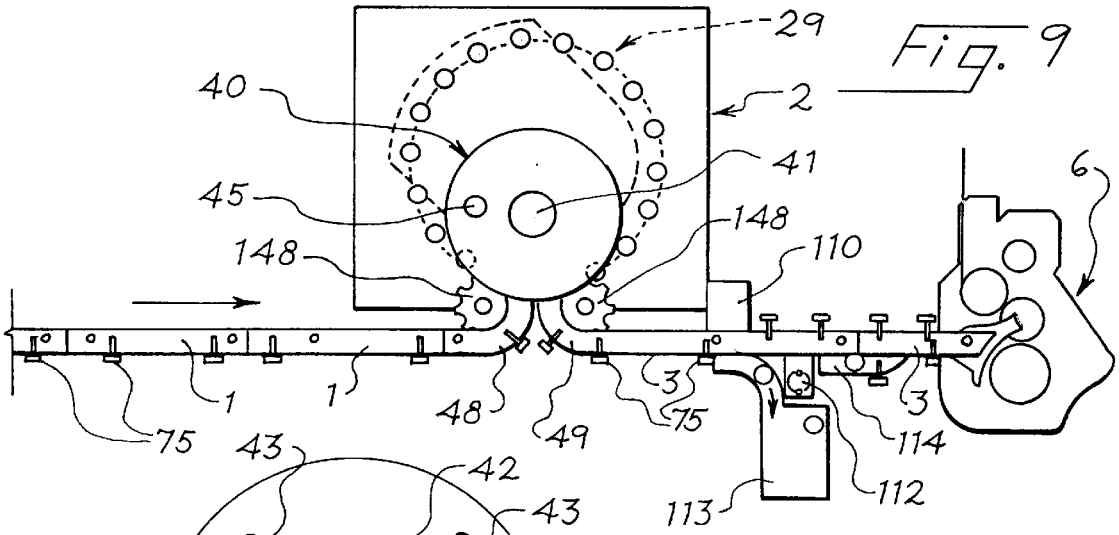
FIG. 9 is a top view of the embodiment shown in FIG. 8.
Figure 10:
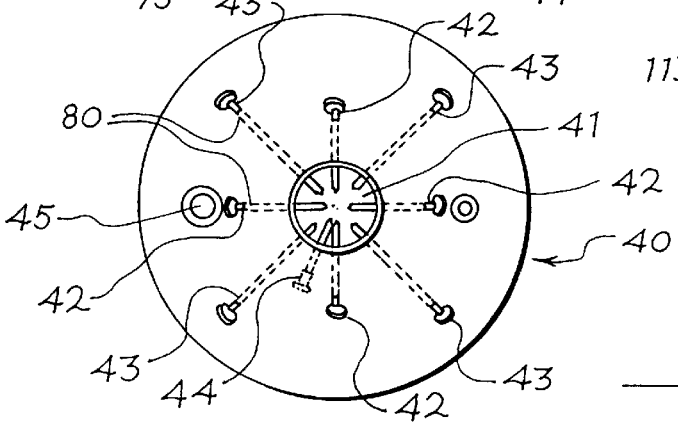
FIG. 10 is a top view of the gassing hopper shown in FIGS. 8–9.

A representative commercial system utilizing the present invention is diagrammatically illustrated in FIGS. 8–10. A series of empty containers 50 is supplied to a filler station 2 by conveyor 59, beneath a segmented and hinged pre-purging rail 1. Nitrogen gas is supplied to the plenum of each rail segment, by means of hoses (not illustrated) attached to the gas inlets. The gas supply to each rail segment may be preferably individually controlled, so that interruptions of gas to a single segment (i.e. when that segment must be moved for service) need not require disruption of gas flow to the remaining segments. This assures that only a minimum number of containers will be contaminated. For this purpose, a position detector (e.g. proximity detector 120, FIG. 7) may provide a signal indicating whether the rail segment is in its operating position.

The conveyor 59 delivers empty containers 50 to a filler station 2, which may comprise any of a number of known product fillers. For example, check weight, auger, rotary valve, in-line indexing, net weigh, and other known apparatus for portioning product and filling containers may be used. The system illustrated includes a circular filler turret 29 for delivering product to the containers and a filler bowl 28 for portioning the bulk feed material and distributing it to the filler turret.

The filler bowl 28 and other elements of the filler are preferably sealed and supplied with an alternate environment (e.g. inert gas). For example, gas inlets 46 may be provided. By properly enclosing the necessary portions of the filler, oxygen contamination may be prevented as the processed product passes from the hopper 40 into the containers 50. An oxygen sensor 47 may also be provided in the filler bowl or other locations within the filler apparatus.

The bulk material 9 is supplied to the filler bowl 28 by means of a storage or flow buffer hopper 40. The hopper is provided with a plurality of gassing element inlets 42, 43. In preferred embodiments, an oxygen sensor 44 is provided at the outlet of hopper 40, to permit monitoring of the residual oxygen in the material fed to the filler. Preferably a vent 45 is provided to exhaust any excess flushing gas and the displaced oxygen atmosphere. Vent 45 may, for example, be attached to a roof ventilation outlet, as may exhaust plenums 37 if used. The vent may include a pressure relief valve, to maintain a slight (e.g. 1–2 inches water column) positive pressure within the interior of the filler. This helps to exclude oxygen infiltration, particularly during idle periods when the outlets for bulk material (through which the containers are filled) are potentially exposed.

In a preferred embodiment, the pressure relief valve may include a valve chamber having an interior bore with a lower shoulder, and a "floating" valve member supported on the shoulder. When excessive pressure develops within the filler bowl, this pressure acting against the surface area of the valve element will lift it from the shoulder, providing a path to vent gases. By adjusting the weight of the valve member (or providing other biasing means), the set point of the pressure relief valve may be adjusted for a particular filler and bulk material. The pressure relief valve may be formed with quick connect clamp ferrules on one or both ends, to allow it to be quickly attached to a cooperating ferrule on the filler. A ferrule on the outlet of the valve allows quick connection to e.g. an exhaust system. A filter element is preferably included, to prevent particulate material from entering the exhaust system or fouling the valve.

In typical rotary fillers, star wheels 48 or other similar systems are used to receive containers from a linear conveyor and place them in the rotating filler apparatus, and similarly to remove filled containers from the rotating apparatus and deliver them to a linear output conveyor. Where such structures are part of the particular filler station 2 utilized, corresponding gas purging rails may be provided to correspond to the curvilinear container path. For example, the pre-purging rail segment 48 includes a curved portion dimensioned to accommodate the path of container travel as empty containers are loaded into the filler illustrated. Similarly, headspace rail segment 49 includes a curved portion corresponding to the travel path of filled containers as they exit the filler. It will be understood that other shapes and dimensions of gas purging rails may be provided to accommodate the particular can paths of numerous filler apparatus.

Headspace purging rails 3 are shown, in conjunction with conveyor 59, to transport the filled containers 52 to a sealing device 6. This may comprise, in preferred embodiments, a rotary double seam seamer for use with cans and lids having preformed curls. It should be understood that other forms of sealers, in conjunction with cans or other forms of containers, may similarly be utilized. Further, the headspace purging rails should accommodate substantially all travel of the can to, and into, the sealer. If necessary, gassing elements may also be provided within the sealer to prevent oxygen contamination during the sealing operation.

In the embodiment of FIG. 8, hopper 40 and gassing elements 42, 43 comprise the controlled environment processor 5 (see FIG. 1) for displacing oxygen from the bulk material 9. Two levels of gassing elements (42, 43) are illustrated. As shown in FIG. 10, preferably four elements are provided in each level, at 90° relative to one another, and the two levels are offset 45° relative to each other. The gassing elements are dimensioned and arranged such that the regions of gas exchange generated by each element overlap with those of neighboring elements. It has been found that a zone of oxygen exclusion thereby results which is effectively continuous across the vessel cross-section. Oxygen containing gases entrained in the bulk material passing through the zone are therefore efficiently displaced by inert gas, and the material exits the zone with a substantially lower residual oxygen content. By providing elements on more than one level relative to product flow, two or more exclusion zones may be generated and the bulk material will be made to pass close to at least one, and in most instances two gassing elements. The amount of oxygen removal can be affected by e.g. the number of gassing elements, their location, the flow rate and type of material through the processor, and the flow rate of gas through the elements. For some products a single level of gassing elements is sufficient, although two are preferred.

At start-up, flow of gas through the manifolds of the pre-purging rails 1 will quickly expel oxygen which may be present in the empty containers 50. Nitrogen is a preferred inert environment, although others may be utilized. Once the various elements have been adequately purged, containers may be processed as previously described. The unique combination of beneficial elements provided by the present invention provides a vary rapid start-up with minimum waste.

FIGS. 8–9 also illustrate diagrammatically certain optional stations that may be beneficially incorporated with an overall system. For example, checkweighers may be included, either after the filler 2, before the filler, or both. By monitoring the weight of filled containers 52, any over- or under-filled container may be identified. Preferably an ejector 110 may then remove the improperly filled container from the conveyor 59, such as by ejecting the can laterally off of the conveyor. Imperfectly processed containers (e.g. potentially including undesirable oxygen levels) may also be ejected. Such functions are made easier by the open architecture of the present invention previously described.

Previously containers which were rejected in this manner were typically discarded, resulting in waste of product and container. To overcome this shortcoming, preferred embodiments of the present invention may include a secondary environmental processor 112. Imperfectly processed containers ejected from the conveyor 59 may be transported to a work and buffer table 113. An operator may then manually adjust the fill of the containers to a proper weight (if necessary), and then process the container by means of the secondary environmental processor 112 to expel oxygen from the container and its contents. By way of example, an apparatus as described in U.S. Pat. No. 5,228,269 owned by the present applicants may be used. Once processed, the container may then be transported beneath a secondary headspace rail 114 which merges with the main headspace rail 3 (e.g. is parallel to and contiguous with rail 3 for a distance). By utilizing a headspace flushing rail in this manner, any oxygen which enters the container as it is removed from the secondary processing station is quickly expelled, and contaminating oxygen is excluded from the container as it is reintroduced into the main container stream prior to the sealing station 6. Once again, this beneficial function is optimized by the open architecture design previously described. Although the use of a secondary environmental processor has been described in conjunction with preferred embodiments including particular forms of gassing rails, it should be understood that these aspects of the present invention may have utility in combination with other environmental processing and/or transportation systems as well.

Figure 11:
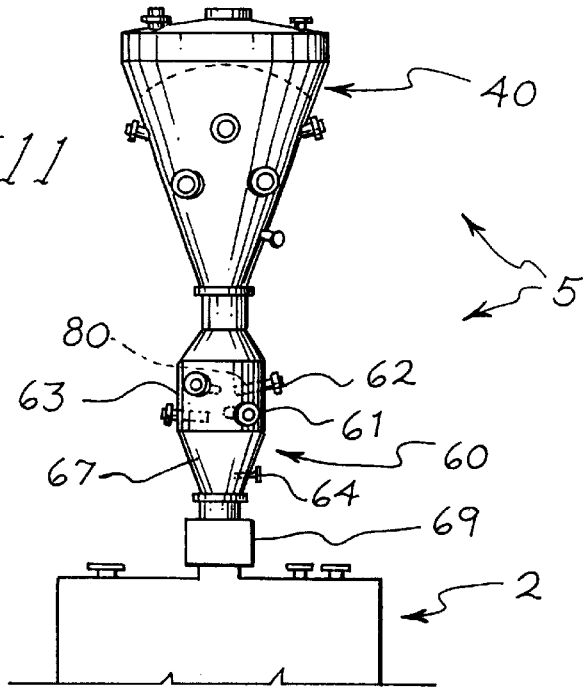
FIG. 11 is a diagrammatic representation of an alternative commercial embodiment, including an on-demand gas exchanger.
Figure 12:
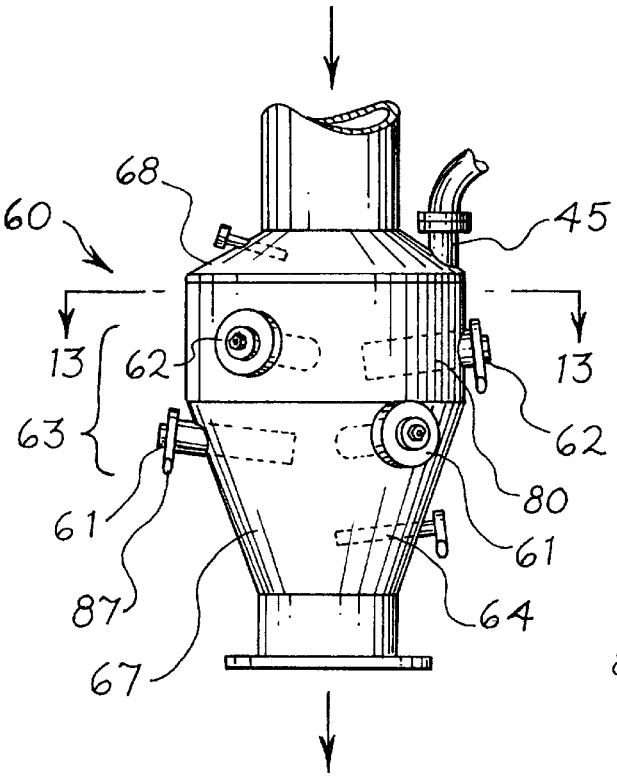
FIG. 12 is a side view of one embodiment of an on-demand gas exchanger.
Figure 13:
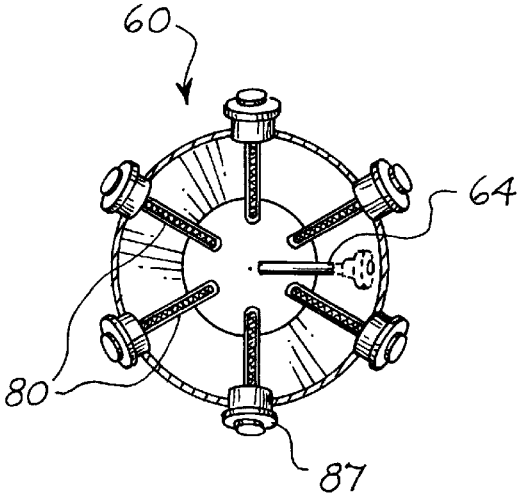
FIG. 13 is a top view of the gas exchanger shown in FIG. 12.

FIGS. 11–13 illustrate alternative and generally preferred embodiments for the controlled environment processor 5. In particular, an on-demand gas exchanger 60 is illustrated, including a plurality of gassing element inlets 61, 62. Although operation of gas exchanger 60 is somewhat similar to that of hopper 40 previously discussed, the exchanger 60 is optimized for fast on-demand processing of relatively rapidly moving product. In a preferred embodiment, the gas exchanger 60 includes a processing region 63 and preferably two levels of three gassing elements each, offset as illustrated. The central processing region 63 provides sufficient interior volume to accommodate gassing elements having sufficient surface area to provide the necessary gas volumes while retaining a controlled and preferably laminarized flow. Residence time of the product passing through the gassing region may also be optimized. However, the volume of region 63 is preferably small enough to permit fast, intimate real-time processing of material as it flows through for packaging.

Outlet section 66 is shown, which may preferably have a conical profile to facilitate particulate material flow. In some embodiments, the gassing elements may be located entirely within a main body of the vessel (e.g. FIG. 11), while in other more compact embodiments, some of the elements may be located in the outlet section 66 as well (e.g. FIG. 12). A corresponding conical inlet section 68 attached to inlet 66 may also be provided, as well as a vent 45 for displaced gases.

An oxygen sensor 64 is preferably provided in the outlet portion 67 to monitor residual oxygen of the material as it is fed to the filler station 2, and one may also be provided at the inlet. Optionally, an isolation or control valve 69 may be provided between the gas exchanger 60 (or hopper 40 of FIG. 8), or other connection means may be utilized to selectively isolate the filler from the controlled environment processor 5.

In use, each gassing element 80 will establish a surrounding gassing region wherein the inert gas introduced through the manifold displaces the ambient oxygen-containing atmosphere from incoming bulk material. By arranging the gassing elements with respect to a relatively compact processing region 63 within the interior of gas exchanger 60, the gassing regions of neighboring elements can be made to overlap such that an effectively continuous gas substitution (oxygen exclusion) zone is established across the entire cross section of the processing region 63 perpendicular to the direction of bulk material flow. Because of the relatively compact dimensions of the preferred gas exchanger, particulate material passing through the processing region 63 is made to pass closely proximate to at least one, and preferably more than one gassing element.

It has been discovered that by establishing an oxygen exclusion zone in this manner, a surprisingly efficient gas exchange ratio may be achieved. For example, it has been found that nearly 98% efficient inert gas utilization can be achieved, whereby each volume of incoming inert gas displaces a substantially equal volume of oxygen-containing entrained atmosphere. It had previously been thought that significant countercurrents of excess inert gas flowing back through the incoming material was necessary or beneficial for efficient gas displacement. Surprisingly, applicants have discovered that such a countercurrent flow is not necessary, and indeed not desirable, particularly in products which are sensitive to flavor stripping.

To facilitate desirable operation, vent 45 may preferably comprise an extended removable filter element to prevent particulate material from entering the exhaust system. For example, a collar having quick connect ferrules on either end can be provided, including means on its interior for receiving a filter element. The filter element may, for example, comprise a 2.5 inch diameter cylinder, approximately 9 inches long, of 5-ply 40 micron screen. The preferred filter element can then be attached to a vent outlet having a cooperating ferrule, or removed for service or cleaning. An exhaust system may be attached to the ferrule on the outlet end.

In some configurations, it may also be desirable to provide a check valve or pressure relief valve in conjunction with the vent. For example, a valve having ferrules at its inlet and outlets, as previously described in connection with a filler, may be provided and attached between the filter collar and an exhaust system. By providing each cooperating element (e.g. vent outlet, filter collar, pressure valve, and exhaust connection) with cooperating ferrules, a system results which can accommodate multiple configurations and rapid assembly/disassembly. In certain embodiments, the filter and valve may be provided in a unitized element.

When material enters the on-demand gas exchanger 60 and encounters the oxygen exclusion zone established by the gassing elements 80, entrained oxygen containing gases will be displaced. This volume of displaced gas may result in an increased pressure in the inlet region 68, which may in turn generate a counter flow of displaced gases. Such a counter flow may disrupt the desired flow of particulate material (e.g. cause bridging or product stratification). To prevent such disruptions, a large input conduit may be used which is dimensioned to accommodate the increased pressure and counter flow. Preferably, however, the pressure relief valve and vent 45 are provided in an inlet region above the gas excluding zone. The displaced gases may then exit without developing a detrimental increased pressure or counter flow of gas, permitting use of more compact transportation conduits.

Bulk material may be provided to the inlet 66 of gas exchanger 60 by any appropriate means. In preferred embodiments, product is supplied from hopper 40 which also includes gassing elements. In this manner, the bulk material in the hopper can be preliminary processed and maintained at a relatively low oxygen level, with the final oxygen reduction accomplished on-demand in the gas exchanger 60. It should be understood, however, that the use of gassified hoppers is optional. Indeed, in many preferred systems the on-demand gas exchanger 60 provides all or substantially all of the inert gas processing required for the filled product, reducing or eliminating the need for slower pre-processing in hoppers. Use of the on-demand gas exchanger in this manner has the benefit of minimizing dwell time of the bulk product within the inert flushing atmosphere. For certain products (e.g. coffee), this flushing is believed to remove desirable aromatic or flavor volatiles, which is detrimental to the product. By minimizing such contact while simultaneously providing highly effective oxygen displacement, adverse effects are minimized or avoided.

FIGS. 14–15 illustrate a presently preferred embodiment of a gassing element 80 that may be used in conjunction with hoppers 40 or gas exchanger 60. The gassing elements preferably have an extended length and a porous but rigid construction. A preferred cross-section includes a tapered top section 81 to displace flowing material around the sides of the gassing element. This minimizes forces acting on the gassing element and has been found to prevent bridging or disruption in the flow of particulate material. To provide greater surface area for preferred gentle passage of a suitable volume of inert gas through the gassing element, generally parallel side portions 82 may also be provided. These provide support to the tapered top portion 81 and add significant additional surface area for gas passage, but do not generate significant additional friction relative to the passing particulate material. Both the top portion 81 and sides 82 are preferably comprised of a stainless steel mesh selected to provide a controlled, and preferably laminarized flow of gas into the bulk material, such as 5-ply 20 micron laminated stainless steel mesh. This provides adequate resistance to distribute the inert gas about the entire surface area of the element manifold and provide a uniform, constant laminar flow, while also providing suitable mechanical strength to the element. It has been discovered that substantially laminar flow is desirable to avoid stratification or separation of different sized particles of product. Use of the present invention has also been found to minimize or eliminate breakdown of fragile particles during de-oxygenation, such as instantized coffees or agglomerized product.

To provide mechanical support to the mesh, a base support 83 and end cap 84 may be provided. Preferably formed of stainless steel, the base support and end cap may include recesses for receiving a removable mesh element, as well as interior strengthening webs if desired. By providing a removable mesh, the manifold may be removed for replacement or cleaning, and all inner portions of the plenum are easily accessible for cleaning.

The gassing elements preferably extend sufficiently inward from the inner wall of a vessel, so that the ends of the plurality of gassing elements are proximate one another, near enough to provide a uniform oxygen-excluding barrier of inert gas, but without obstructing the flow of particulate matter between the elements. The gassing element 80 may preferably be positioned at a downward sloping angle approximately 5° from horizontal. To permit removal of the elements for cleaning or replacement, they are preferably mounted through inlets 85 sanitary welded or otherwise attached to the vessel. A gasket 86 is positioned between mating surfaces of the gassing element 80 and inlet 85. Gassing elements 80 are preferably secured to the inlet 85 by means of a removable clamp 87, such as a stainless steel quick-clamp tube fitting ferrule (3A sanitary rated).

Inert gas is supplied to the gassing element 80 through inlet 88. In conjunction with a hopper, a flow rate ranging between about 1–20 scfm per element and preferably 3–4 scfm has been found beneficial for elements about 15 inches long and ¾ inches wide at the base. As previously noted, the flow rate is dependent on e.g. the type of material being processed, the rate and type of material passing through the hopper, the physical dimensions of the hopper, and the oxygen content of the input material. For example, bulk material which entraps gases (such as in-shell peanuts) may require a higher residence time and/or higher inert gas flow rate. In contrast, relatively large solid product (e.g. shelled and skinned peanuts) may require less residence time and/or gas. By monitoring the residual oxygen content at the output of the hopper, an operator may easily determine an appropriate flow rate for a particular product and setup.

The gassing elements in gas exchanger 60 are preferably identical to those previously described, although the overall dimensions differ to accommodate the smaller size of the gassing region 63. Flow rates per element of about 1–5 scfm per element are desirable, and in particular 1.5–2 scfm has been found beneficial. In a particularly preferred embodiment, 6 elements in two staggered levels (as shown), each about 7 inches long and ¾ inches wide at the base, are provided with 0.4–1.75 scfm for processing infant formula at 200 pounds per minute and higher. It should be understood that other shapes may similarly be used, such as elliptical or other cross-sections.

While the embodiments of the invention disclosed herein are presently considered to be preferred, various changes and modifications can be made without departing from the spirit and scope of the invention. The scope of the invention is indicated in appended claims, and all changes that come within the meaning and range of equivalents are intended to be embraced therein.

We claim:

1. A vessel for processing particulate material to remove oxygen by means of an inert gas, comprising:

a plurality of gassing elements including a length and width and elongated longitudinally oriented manifold surfaces along the length for passing said inert gas into the regions surrounding said manifolds to replace oxygen entrained in the particulate material with the inert gas, each of the manifolds include a first longitudinal end positioned adjacent a sidewall of the vessel and a second longitudinal end extending inward from and spaced apart from the sidewall of the vessel, said gassing elements distributed about the periphery of said vessel which receives the particulate material, the elongated longitudinally oriented manifold surfaces passing into the interior of said vessel such that the second longitudinal end of each manifold is proximate the second longitudinal end of at least one other gassing element manifold.

2. The vessel of claim 1 further characterized by:

each elongated manifold surface of each gassing element generating a gassing zone within which said inert gas displaces entrained oxygen from the incoming particulate material, said gassing elements arranged such that the gassing regions associated with neighboring manifolds overlap, resulting in an effectively continuous gassing zone extending across the entire width of said vessel interior perpendicular to the direction of travel of said particulate material.

3. The vessel of claim 1 further characterized by two or more substantially coplanar levels of gassing elements, each comprising a plurality of gassing elements.

4. The vessel of claim 1 wherein said elongated manifolds are substantially radial relative to an axis of said vessel.

5. The vessel of claim 4 wherein said elongated manifolds are angled in the direction of flow of said particulate matter through said vessel.

6. The vessel of claim 1 wherein said vessel is a hopper having sufficient interior volume adapted for storing bulk quantities of said particulate material and for exposing said particulate material to said inert gas for extended periods to displace oxygen.

7. The vessel of claim 6 further comprising a vent for exhausting at least a portion of said displaced gases.

8. The vessel of claim 1 wherein said vessel is an on-demand processor having restricted interior volume adapted for conveying flowing particulate material in close proximity to said manifolds with minimum residence time within said vessel, while displacing substantially all oxygen from said material as it flows through said vessel.

9. The vessel of claim 8 further comprising a vent for exhausting at least a portion of said displaced gases.

10. An apparatus for removing a first entrained atmosphere from a flow of particulate material and replacing it with a select alternate environment, comprising:

an on-demand processor for removing said first entrained atmosphere from a flow of particulate material in real time, said on-demand processor comprising a vessel having a restricted interior volume for accommodating a flow of said particulate material as part of a processing system, a plurality of gassing elements including a length and width and elongated longitudinally oriented manifold surfaces along the length for passing said select alternate environment into gassing regions surrounding each of said manifolds to replace the first entrained atmosphere with the select alternate environment, each of the manifold surfaces including a first longitudinal end positioned adjacent a sidewall of the vessel and a second longitudinal end extending inward and spaced apart from the sidewall of the vessel, said gassing elements distributed about the periphery of said vessel with said elongated longitudinally oriented manifold surfaces passing into said interior of said vessel such that the second longitudinal end of each manifold is proximate the second longitudinal end of at least one other gassing element manifold.

11. The apparatus of claim 10 further comprising:

each elongated manifold surface of each gassing element generating a gassing region within which said select alternate environment displaces said first entrained atmosphere from a portion of the incoming particulate material flow, said gassing elements arranged such that the gassing regions associated with neighboring manifolds overlap, resulting in an effectively continuous environment displacing zone extending across the entire width of said vessel interior perpendicular to the direction of flow of said particulate material.

12. A method of processing a flow of particulate material to replace a first entrained atmosphere with a select alternate environment, comprising the steps of:

causing said particulate material to flow through a processor having a processing region, providing a plurality of gassing elements having a length and width and elongated longitudinally oriented manifold surfaces along the length for passing said select alternate environment into regions of said particulate material flow adjacent to said manifolds to replace the first entrained atmosphere with the select alternate environment, each of the elongated longitudinally oriented manifold surfaces including a first longitudinal end positioned adjacent a sidewall of the vessel and a second longitudinal end extending inward and spaced apart from the sidewall of the vessel, said elongated longitudinally oriented manifold surfaces passing into said processing region of said processor such that the second longitudinal end of each manifold is proximate the second longitudinal end of at least one other gassing element manifold, each elongated manifold surface of each gassing element generating a gassing region within which said select alternate environment displaces said first entrained atmosphere from a portion of said particulate material flow, and said gassing elements arranged such that the gassing regions associated with neighboring manifolds overlap, resulting in an effectively continuous environment displacing zone extending across the entire width of said processing region perpendicular to the direction of flow of said particulate material.

13. A gassing element comprising:

a mounting collar for cooperating with an aperture formed in a vessel for processing particulate material to remove oxygen by means of inert gas;

an inert gas inlet port supported by and on a first side of said mounting collar;

an elongated longitudinally oriented gas manifold on a second side of said mounting collar, said gas manifold comprising a support frame extending away from said mounting collar, and an elongated longitudinally oriented gas permeable member supported by said frame and defining in part a distribution plenum functionally coupled to said gas inlet, said elongated longitudinally oriented gas permeable member including at least a top portion which is generally tapered in a direction transverse to the elongated axis extending along a length of said gas manifold, said elongated longitudinally oriented gas manifold including a cross-section which permits the manifold to pass through said aperture, said elongated longitudinally oriented gas manifold including a first end for positioning adjacent the aperture and a second end for extending into the vessel and spaced apart from the aperture and of the vessel wall, wherein the elongated gas manifold is oriented radial relative to an axis of the vessel.

14. The gassing element of claim 13 wherein said gas permeable member comprises a fine wire mesh, and wherein gas flow from said manifold is substantially laminar.

15. The gassing element of claim 13 wherein said gas permeable member is removable from said support frame to permit access to the interior of said distribution plenum.

16. The gassing element of claim 13 wherein said gas permeable member further comprises a lower portion providing additional gas permeable surface area having generally parallel sides.

* * * * *